US007264534B2

(12) United States Patent
Stubenfoll

(10) Patent No.: US 7,264,534 B2
(45) Date of Patent: Sep. 4, 2007

(54) TOYS WITH DRIVEN CHARACTERS

(75) Inventor: Leonard J. Stubenfoll, Orland Park, IL (US)

(73) Assignee: Fertig Stubenfoll Design Group, L.L.C., Oak Brook, IL (US)

( * ) Notice: Subject to any disclaimer, the term of this patent is extended or adjusted under 35 U.S.C. 154(b) by 38 days.

(21) Appl. No.: 11/026,602

(22) Filed: Dec. 30, 2004

(65) Prior Publication Data

US 2006/0148377 A1 Jul. 6, 2006

(51) Int. Cl.
*A63H 33/02* (2006.01)
*A63H 33/00* (2006.01)

(52) U.S. Cl. ..... 446/227; 446/330

(58) Field of Classification Search ..... 446/227, 446/330, 354, 353, 331, 136, 139; 40/411, 40/414, 415, 418, 420
See application file for complete search history.

(56) References Cited

U.S. PATENT DOCUMENTS

| | | | | |
|---|---|---|---|---|
| 186,737 | A | | 1/1877 | Kirchner |
| 450,495 | A | | 4/1891 | Pugsley |
| 2,525,140 | A | | 10/1950 | Lerman |
| 2,769,276 | A | | 11/1956 | Steiner |
| 2,953,869 | A | | 9/1960 | Collischan |
| D191,115 | S | | 8/1961 | Okamoto |
| 2,994,156 | A | | 8/1961 | Steiner et al. |
| 3,153,871 | A | | 10/1964 | Semba |
| 3,290,817 | A | | 12/1966 | Kravath |
| 3,719,002 | A | | 3/1973 | Jernstrom |
| 3,919,795 | A | | 11/1975 | Van Horne Jinivisian et al. |
| 3,927,482 | A | | 12/1975 | Marcus |
| 3,978,610 | A | | 9/1976 | Stubbmann |
| 3,983,647 | A | | 10/1976 | Stubbmann |
| 4,040,206 | A | * | 8/1977 | Kimura ..... 446/352 |
| 4,146,224 | A | * | 3/1979 | Deutsch ..... 273/108.52 |
| 4,188,745 | A | | 2/1980 | Harvey et al. |
| 4,214,808 | A | | 7/1980 | Hampson |
| 4,285,028 | A | | 8/1981 | Sundin et al. |
| 4,389,811 | A | | 6/1983 | Iwaya et al. |
| 4,425,388 | A | | 1/1984 | Oppenheimer, Jr. |
| 4,449,321 | A | | 5/1984 | Reiling |
| 4,561,549 | A | | 12/1985 | Yokohori |
| 4,600,399 | A | | 7/1986 | Abe |
| D285,946 | S | | 9/1986 | Toth |
| 4,627,588 | A | | 12/1986 | Block |
| 4,664,640 | A | | 5/1987 | Shindo et al. |
| 4,702,719 | A | | 10/1987 | Lapid |
| 4,722,713 | A | | 2/1988 | Williams et al. |

(Continued)

FOREIGN PATENT DOCUMENTS

EP 0 818 698 A1 6/1997

(Continued)

*Primary Examiner*—Kien T Nguyen
(74) *Attorney, Agent, or Firm*—John S. Pacocha

(57) ABSTRACT

Toys for infants in the form of soothers, mobiles, swings, and gyms are provided with a housing, at least one character carried by the housing for movement relative to the housing, the at least one character having a body and at least one appendage that is carried by the body for movement relative to the body, a drive assembly carried by the housing to simultaneously drive the body of the at least one character to move relative to the housing and drive the at least one appendage to move relative to the body.

11 Claims, 11 Drawing Sheets

U.S. PATENT DOCUMENTS 4,756,614 A 7/1988 Kato et al.
4,858,079 A 8/1989 Ohashi
4,901,459 A * 2/1990 Lee ..... 40/414
4,904,220 A 2/1990 Williams et al.
4,942,502 A 7/1990 Ohashi
4,984,380 A 1/1991 Anderson
5,029,047 A 7/1991 Kachel
5,076,520 A 12/1991 Bro
D324,351 S 3/1992 Shing
5,187,826 A 2/1993 Mariol
D336,495 S 6/1993 Raiffe et al.
5,266,980 A 11/1993 Gussin et al.
5,307,051 A 4/1994 Sedlmayr
5,310,377 A 5/1994 Joja
5,311,226 A 5/1994 Karasawa
5,316,516 A 5/1994 Saitoh
5,367,349 A 11/1994 Zeiler
5,387,146 A * 2/1995 Smith et al. ..... 446/175
5,400,534 A 3/1995 Lin
5,413,517 A * 5/1995 Kamijima ..... 446/354
D359,869 S 7/1995 Oren
5,451,095 A 9/1995 Riback
5,478,268 A 12/1995 Au
5,509,721 A 4/1996 Huang
5,517,264 A 5/1996 Sutton
5,545,072 A 8/1996 Arad et al.
5,655,767 A * 8/1997 Francis et al. ..... 273/108.1
5,769,684 A 6/1998 Lou
5,841,585 A 11/1998 Katou et al.
5,887,945 A 3/1999 Sedlack
D408,192 S 4/1999 Chiang
5,928,054 A 7/1999 Mast
5,930,854 A 8/1999 O'Neill et al.
6,009,647 A 1/2000 Feingold
6,042,446 A * 3/2000 Louis ..... 446/170
6,068,285 A 5/2000 Jackson et al.
6,084,527 A 7/2000 Spector
6,113,455 A * 9/2000 Whelan et al. ..... 446/227
6,203,395 B1 3/2001 McElhaney
D450,516 S 11/2001 Darling et al.
6,332,824 B2 12/2001 Tell et al.
6,343,994 B1 2/2002 Clarke
6,447,362 B2 9/2002 Khamphilavong et al.
6,464,594 B1 10/2002 Canna et al.
6,471,597 B1 10/2002 Flannery et al.
6,482,066 B1 11/2002 Kelly
6,520,862 B1 2/2003 Armbruster et al.
6,561,915 B2 5/2003 Kelly et al.
6,572,433 B1 * 6/2003 Hou ..... 446/353
6,574,812 B2 6/2003 Jakubowski et al.
6,592,425 B2 7/2003 Bapst et al.
6,594,840 B2 7/2003 Tomas et al.
6,629,727 B2 10/2003 Asbach et al.
6,702,643 B1 3/2004 Drosendahl et al.
6,705,950 B2 3/2004 Wood et al.
2002/0094748 A1 7/2002 Baik
2003/0003427 A1 1/2003 Wood et al.
2003/0064818 A1 4/2003 Drosendahl et al.
2003/0171065 A1 9/2003 Greenberg

FOREIGN PATENT DOCUMENTS

FR 2642323 8/1990
FR 2660573 10/1991
GB 2 279 265 A 4/1995
WO WO90/08582 9/1990
WO WO 03/009917 A1 2/2003

* cited by examiner

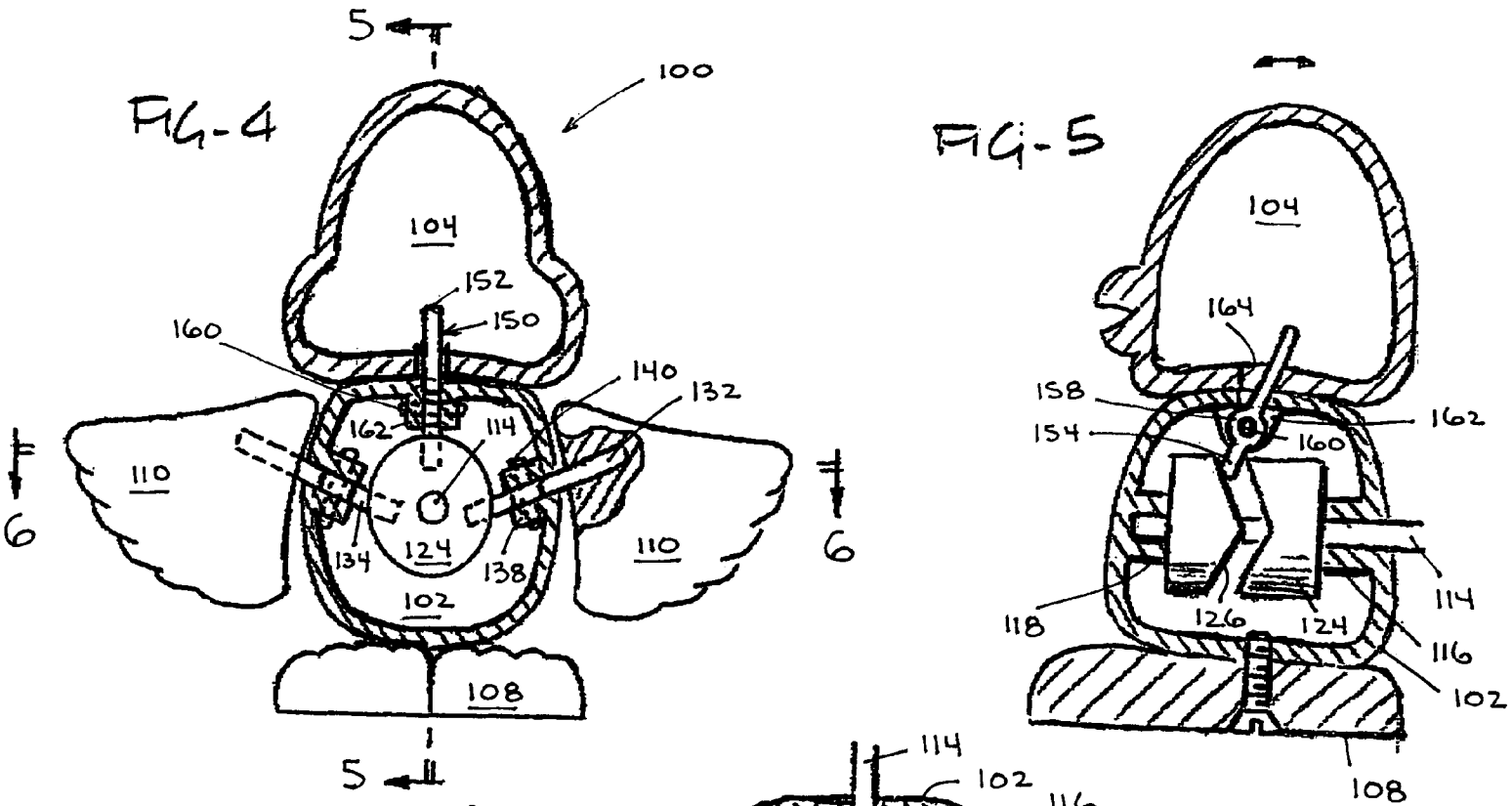
FIG-4
FIG-5
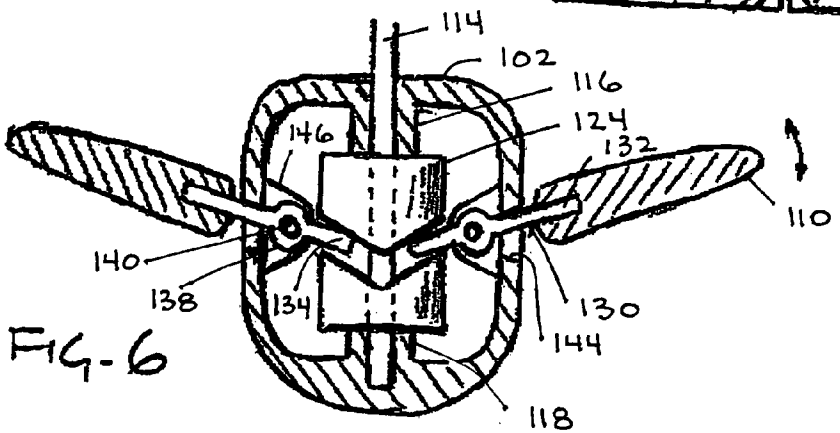
FIG-6

TOYS WITH DRIVEN CHARACTERS

BACKGROUND OF THE INVENTION

1. Field of the Invention

This invention relates generally to toys, particularly toys for infants, in which characters are driven in a manner suitable for amusing, entertaining, soothing, quieting and/or stimulating infants.

2. Background Art

Toys with rotatable pieces, including driven pieces have been used for amusing, entertaining, soothing, quieting and/or stimulating infants, including while the infants are in their cribs or in seats that swing or bounce. Toth, Des. 285,946 issued Sep. 30, 1986 discloses a mobile with a motor rotating a number of characters on flexible members. Raiffe et al., Des. 336,495 Jun. 15, 1993 discloses a mobile with a motor rotating a number of characters, including birds, on flexible members. Whelan, U.S. Pat. No. 6,113,455 issued Sep. 5, 3000 and Drosendahl et al., Application US 3003/0064818 A1 published Apr. 3, 3003 disclose a crib mobile with a motor rotating a number of characters on flexible members. Canna et al., U.S. Pat. No. 6,464,594 B1 issued Oct. 15, 3002 discloses a mobile with a motor rotating a number character on flexible members, which is carried above an infant's swing seat, while Wood et al., U.S. Pat. No. 6,705,950 B2 issued Mar. 16, 3004 discloses a non-motorized, rotatable mobile with a number of characters on flexible members, which is carried above an infant's swing seat. Asbach et al., U.S. Pat. No. 6,629,727 B2 issued Oct. 7, 3003 discloses a mobile with a motor rotating a number character on flexible members, which is positionable to the side of, or above, an infant's bouncing seat.

Van Home Jinivisian et al. U.S. Pat. No. 3,919,795 issued Nov. 18, 1975 discloses a motorized crib mobile with a shaft carrier rotating about a generally vertical axis and a cam follower on each shaft oscillationally rotates each shaft on its own axis as the shaft carrier rotates relative to the fixed housing. Williams et al., U.S. Pat. No. 4,904,320 issued Feb. 27, 1990 discloses a crib mobile with paddles that are rotated around a generally vertical axis by a motor, and which are pivotally mounted to be manually moved between two positions. Armand, French Patent FR2,642,323 published Aug. 3, 1990 and PCT Application WO 90/08582 published Aug. 9, 1990 disclose a motor driven mobile with peripheral pieces that rotate around a central axis, with each piece containing a character having another axis of rotation, which is shorter than the inner diameter of the piece.

Birds have been the subject of devices for amusing adults, as well as children. Thus, Lerman, U.S. Pat. No. 2,525,140 issued Oct. 10, 1950 discloses a clock with a bird on a perch in a cage that is driven by a motor to swing back and forth like a pendulum. Okamoto, Des. 191,115 issued Aug. 16, 1961 discloses a suspended toy bird with extended wings.

Indeed characters, such as birds, with movable wings have also been used for entertaining and amusing infants, as well as adults. Pugsley 450,495 issued Apr. 14, 1891 discloses a toy bird with wings that may be moved from a biased open position, extended away from the body, to a closed position adjacent the body. Collischan U.S. Pat. No. 2,953,869 issued Sep. 27, 1960 discloses a toy bird with a motor in its body that causes a beak to open and close, a head to turn, sound produced, and a tail and wings to move up and down, or flutter. Semba, U.S. Pat. No. 3,153,871 issued May 18, 1962 discloses a bird toy with a motor in its body that causes a beak to open and close, a tail to move, and wings to move up and down, or flutter, while Iwaya et al., U.S. Pat. No. 4,389,811 issued Jun. 28, 1983 discloses a bird action toy with a motor in its body that causes a beak to open and close, produce chirping sounds, and a tail to move. Saitoh, U.S. Pat. No. 5,316,516 issued May 31, 1994 discloses an animated singing toy bird with a motor in the body to move the body relative to the legs, move the head relative to the body, and open and close the beak.

Toys that have rotating characters, particularly birds, with movable appendages, such as wings, have also been used for entertaining and amusing infants. Steiner et al., U.S. Pat. No. 2,994,156 issued Aug. 1, 1961, Steiner, U.S. Pat. No. 2,769,276 issued Nov. 6, 1956 and Kravath, U.S. Pat. No. 3,290,817 issued Dec. 13, 1966 discloses a crib mobile with a number of birds having extended wings that can flutter. Oppenheimer, Jr., U.S. Pat. No. 4,425,388 issued Jan. 10, 1984 discloses a bird mobile with extended wings that move downwardly and upwardly. Baik, Application US 3002/0094748 A1 published Jul. 18, 3002 discloses a baby mobile with a number of flying fish or birds, each of which is manually rotatable into an indexed position in which electrical is made to power a motor which can move wings on the fish or bird in and up and down fluttering action, until the mobile is manually rotated again.

There remains a need for toys for infants, in which characters are driven by a motor in a manner suitable for amusing, entertaining, soothing, quieting and/or stimulating infants.

SUMMARY OF THE INVENTION

The present invention is concerned with providing toys with a housing, at least one character carried by the housing for movement relative to the housing, the at least one character having a body and at least one appendage that is carried by the body for movement relative to the body, a drive assembly carried by the housing to simultaneously drive the body of the at least one character to move relative to the housing and drive the at least one appendage to move relative to the body.

BRIEF DESCRIPTION OF THE DRAWINGS

For a better understanding of the present invention, reference may be had to the accompanying drawings in which:

FIG. 4 is an enlarged sectional view taken generally vertically through the center, front to back, of one of the three smaller orbiting characters of the embodiment shown in FIG. 1;

FIG. 5 is a sectional view taken generally along line 5-5 of FIG. 4;

FIG. 6 is a sectional view taken generally along line 6-6 of FIG. 4;

DETAILED DESCRIPTION

The present invention relates to toys that serve to amuse, entertain, soothe, quiet and/or stimulate infants. To accomplish these purposes toys may use colors, sounds, characters, and/or movement. While toys made in accordance with the present invention may incorporate colors and sounds in addition to movement, this description will be directed to movement of characters. Thus, in the illustrated embodiments, there is shown in FIGS. 1 through 6 a toy "soother" 30, having a housing 32. Soother 30 is generally vertically oriented Indeed, the particular embodiment shown in FIGS. 1 through 6 may be a self-standing unit, which may be positioned on a bureau, nightstand or table in the baby's room. Alternatively, a soother of a present invention may be adapted in conventional ways to be hung on a wall or over the side or end of a crib.

Figure 1:
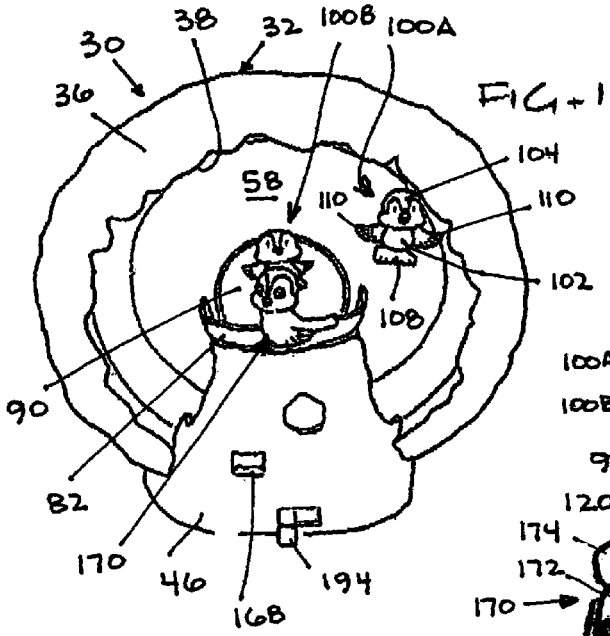
FIG. 1 is a front view of an embodiment of the present invention.
Figure 2:
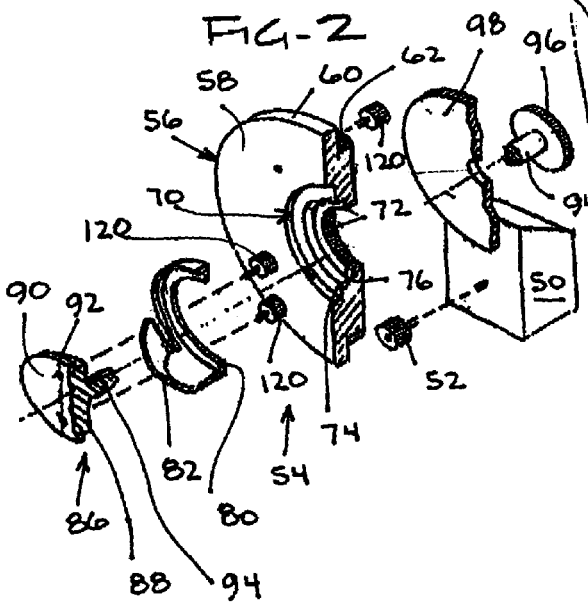
FIG. 2 is an enlarged, exploded perspective view of a portion of the mechanism of the embodiment shown in FIG. 1.

Housing 32 includes a generally vertically extending rear wall 34 with a forwardly projecting, generally toroidal enclosure portion 36 around a generally central opening 38, which is generally circular when viewed from the front as in FIG. 1. Enclosure 36 may be aesthetically designed in keeping with the theme of this disclosed embodiment to be surrounded by clouds or leafy branches. The upper portion of enclosure 36 has an inwardly recessed, downwardly depending retaining wall 40. In addition, housing 32 includes a lower, forward portion 46, which aesthetically may be the form of a tree trunk.

Positioned in the lower rear of housing 32, is a motor 50. Most conveniently, motor 50 is a battery powered motor. However, motor 50 may just as readily for purposes of the present invention be a plug-in, AC powered motor, or even a mechanical, wind up spring, motor. Extending forwardly from motor 50 is a drive pinion 52.

Figure 3:
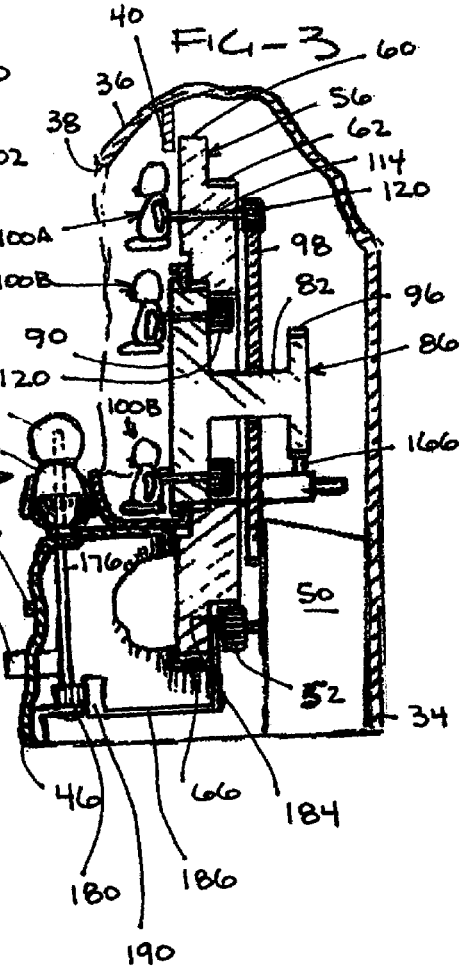
FIG. 3 is an enlarged sectional view taken generally vertically through the center, side to side, of the embodiment shown in FIG. 1.

For purposes of the present invention, drive pinion 52 could as readily be a friction drive rather than a gear. However, as shown in the drawings, and as will further be described, the drive assembly 54 of the present invention is shown and will be described, this embodiment is provided with a drive assembly 54 having gears, rather than a friction drive. More particularly, drive assembly 54 includes a main disk 56 having an outer face 58, and an outer periphery 60. Opposite outer face 58, and of a lesser diameter than outer periphery 60, is a gear 62, which is integrally formed as part of disk 56. Disk 56 is captured for rotation within housing 32 by a pair of spaced apart lower rollers 66, one of which is shown in FIG. 3, on which outer periphery 60 rides, and depending retaining wall 40. Gear 62 is engaged by drive pinion 52 to rotate disk 56.

Centrally disposed in disk 56 is a stepped-down opening 70, which includes an integrally formed internal gear 72 opposite outer face 58. Extending inwardly from outer face 58 of disk 56, through central opening 70 is an outermost, recessed annular flange 74, and a second inner annular flange 76 of a smaller diameter than flange 74. A mounting ring 80 fits into outer recessed annular flange 76, but does not rotate with disk 56. Integrally formed as part of mounting ring 80 is an outwardly extending, simulated nest 82, which, as is illustrated in FIGS. 1 and 3, sits atop trunk portion 46 of housing 32.

An inner disk assembly 86 includes an outer disk 88 having an outer face 90. There is a peripheral lip 92 extending out circumferentially from outer face 90 that is of a greater diameter than the body of disk 88. Extending rearwardly from disk 88 is an axle 94, which is secured at its rearward end, opposite disk 88, to a gear 96, for rotation with gear 96. Disk assembly 86 fits through the stepped-down central opening 70, as well as through mounting ring 80, except for lip 92, which abuts against mounting ring 80 to retain it, and the integrally formed simulated nest 82, positioned axially forward of main disk 56. Positioned between the back of main disk 56 and gear 96 of inner disk assembly 86 is a gear 98.

Soother 30 includes three characters 100, which conveniently in keeping with the aesthetic theme of soother 30, as illustrated in FIGS. 1 and 3, are in the form of baby birds. Characters 100 can of course, be made of any convenient selected type. While flying creatures such as birds and butterflies are particularly adapted to the general theme of the presently disclosed embodiment, toys having different themes could of course have characters of a different type more appropriate to their themes. Each of characters 100 have a body 102, a head 104, a tail 108 and a pair of appendages in the form of wings 110. As is best illustrated in FIGS. 4, 5 and 6, wings 110 are carried for movement relative to body 102. In addition head 104 is carried for movement relative to body 102. Each character 100, more particularly each body 102, is itself carried by housing 32, or more particularly drive assembly 54, for movement relative to the housing.

Extending rearwardly from each body 102 is a shaft 114. As is best illustrated in FIG. 5, one end of shaft 114 is journalled in body 102 through a rear trunnion 116 and a front trunnion 118. Secured to the other end of shaft 114, for rotation with shaft 114, is a pinion gear 120. Referring back to FIGS. 1 and 3, one of baby bird characters 100A is carried for rotation by main disk 56 40. More particularly, shaft 114 of character 100A extends through an aperture 120 124, which extends all the way through from outer face 58 to the back of disk 56. Again, as is best illustrated in FIG. 3, baby bird character 100A will rotate generally about the axis of inner disk assembly 82 relative to housing 32 as drive pinion 52 of motor 50 rotates and engages gear 62 integrally formed as part of main disk 56. At the same time, as disk 56 rotates about the axis of inner disk assembly 86, gear 120 of character 100A will engage gear 90 causing shaft 114 to rotate.

Each of baby bird characters 100B and 100C are carried by inner disk assembly 86 in a manner similar to that described with respect to character 100A and main disk 56. There is a difference, however, in what gear is engaged by the gears 120 of characters 100B and 100C; rather than engaging gear 90, gears 120 of characters 100B and 100C engage inner gear 72 integrally formed as part of main disk 56.

Referring now to FIGS. 4 through 6, secured to shaft 114 for rotation with shaft 114 is a cylinder 124 having a cam slot 126. As is shown in FIGS. 5 and 6, cam slot 126 extends around the entire circumference of cylinder 124 in a generally sinusoidal, or up and down, manner. Each pair of wings 110 is carried by a respective body 102 for movement relative to that body. More particularly, a pivot arm 130 connects each wing 110 to body 102. Each pivot arm 130 has an outer portion 132 secured to wing 110, and an inner, cam follower portion 134. Between outer portion 132 and cam follower 134 is a mounting boss 138 with a generally central aperture that fits over a pin 140 for rotation about the axis of pin 140. Rotation of arm 130 is restricted by a slot 144 in body 102 through which pivot arm 130 extends. Pin 140 is carried by inwardly directed tabs 146, which may be integrally formed as part of body 102. Thus, it will be appreciated, particularly from the illustrations of FIGS. 4, 5 and 6, that as cylinder 124, with its cam slot 126, rotates about the axis of shaft 114, engagement of cam followers 134 of the respective pivot arm 130 of each of wings 110 will cause the wings to be driven in a front to back, back and forth motion, simulating "flapping" of the wings, as illustrated by the arrows at the end of each wing tip in FIG. 6. Moreover, it will be appreciated, particularly from FIGS. 3 through 6, that as motor 50, through drive pinion 52, drives main disk 56 causing each of baby bird characters 100 to rotate relative to housing 32, generally about the axis of inner disk assembly 86, because of the simultaneous engagement of gears 120 with gear 90 in the case of character 100A, and gear 72 in the case of characters 100B and 100C, appendages or wings 110 will be driven to move relative to the body of each of the characters in a generally front to back "flapping" action.

As is best illustrated in FIGS. 4 and 5, head 104 of each character 100 is also carried by body 102 for movement relative to body 102 in a generally back and forth "bobbing" action. Head 104 is connected to body 102 by a pivot arm 150, which is similar to pivot arm 130. Pivot arm 150 has an outer portion 152 extending into head 104 and an inner cam follower 154 within body 102. A mounting boss 158 between outer portion 152 and cam follower 154 is mounted for rotation about a pin 160 carried by tabs 162. A slot 164 in the bottom of head 104 limits the rotation of mounting arm 150 to a back and forth pivoting movement, which is transmitted to head 104 to cause it to pivot back and forth relative to body 102.

Inner disk assembly 86 is normally stationary while main disk 56 rotates because of the engagement of a brake 166 with gear 96 of inner disk assembly 86. Pushing in button 168 moves brake 166 rearwardly toward rear wall 34, and out of engagement with gear 96 of inner disk assembly 86 allowing it to rotate along with main disk 56 because of frictional engagement.

A mother bird character 170 is positioned atop trunk 46, forward of nest 82. Character 170 has a body 172 and a head 174, which is rotatable relative to body 172 about a generally vertical axis. More particularly, head 174 is secured to a shaft 176, for oscillation with the shaft, which is journalled for oscillation within body 172. Projecting forwardly from drive pinion 52 is an eccentric pin 184, which engages a slot in a generally L-shaped shuttle member 186. At the forward end of shuttle member 186 is a rack 190 which engage gear 180 and partially rotates the gear, shaft 176, and head 174 first in one direction, and then in the opposite direction.

Shaft 176 is flexible, such that it may be deflected from its normally, generally vertical axis. An actuator 194, accessible near the lower front of simulated tree trunk portion 46 deflects shaft 176 and head 174 to enhance the simulation of the mother bird character 170 feeding one of the baby bird characters 100B or 100C. At the bottom end of shaft 176, opposite head 174, is a gear 180.

Figure 7:
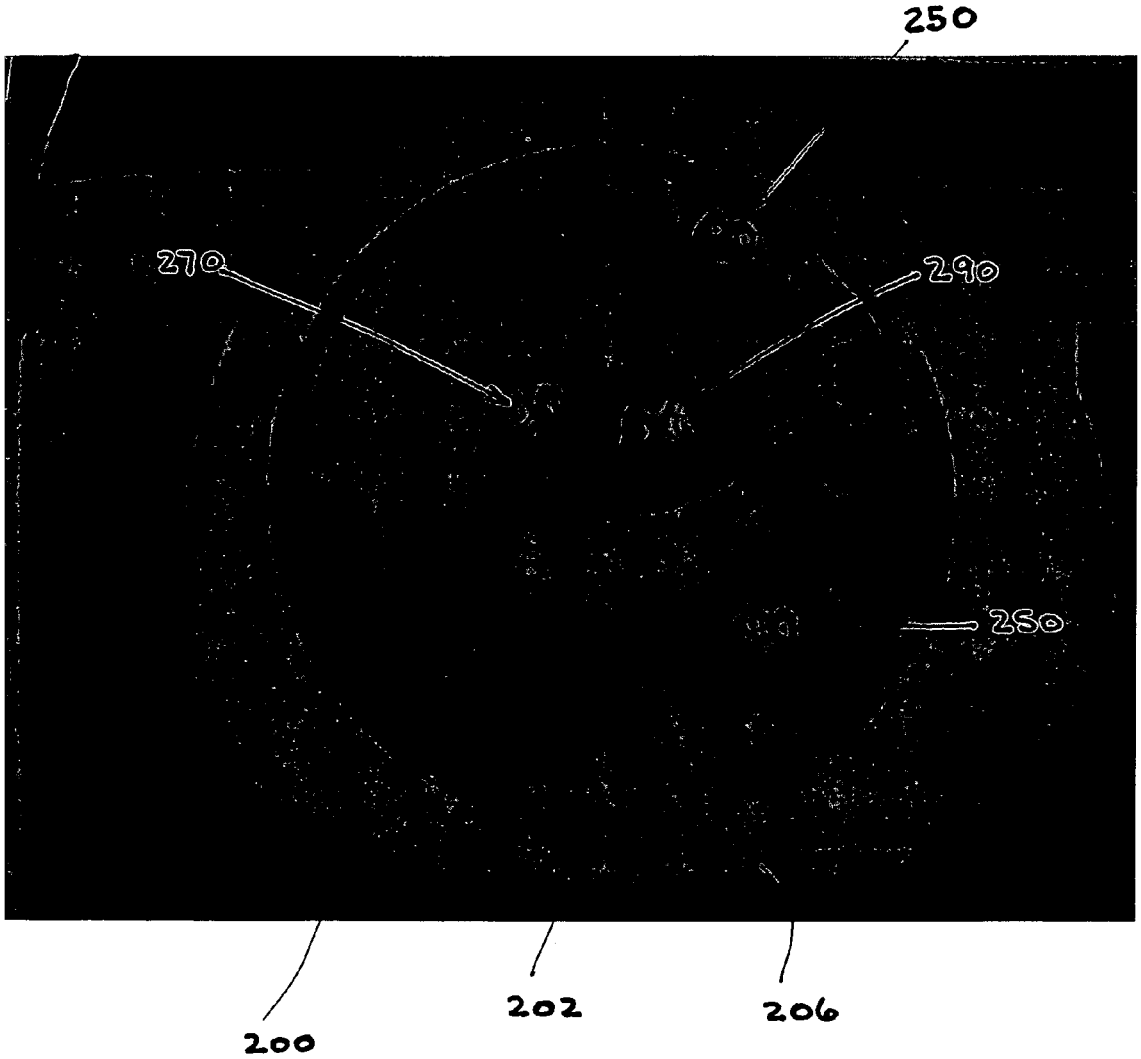
FIG. 7 is a perspective view of an additional embodiment of the present invention.
Figure 8:
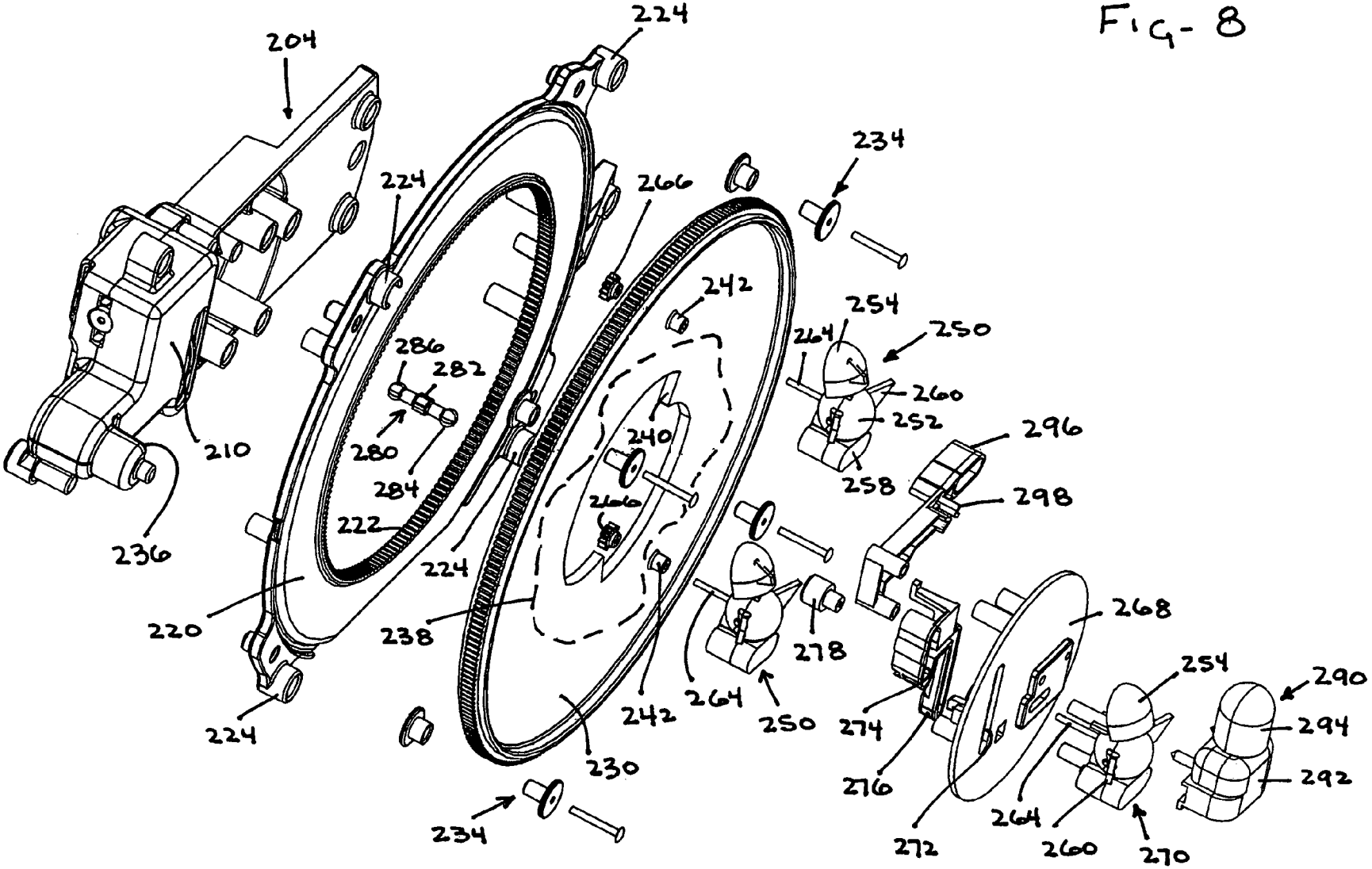
FIG. 8 is an exploded parts view of the embodiment shown in FIG. 7.

An additional embodiment of a soother 200 of the present invention is shown in FIGS. 7 and 8. Soother 200, having a housing 202, is generally vertically oriented, and as shown in FIG. 7 is hung over the side or end of a crib. Housing 202 includes a back portion 204 and a front, generally circular portion 206. Although expressed somewhat differently, this embodiment, including front portion 206, again has a theme of clouds and leafy arbors for which flying characters such as butterflies and birds are appropriate.

Back portion 204 includes a motor 210, which is conveniently a battery powered motor. However, as before, motor 210 may just as readily for purposes of the present invention be a plug-in, AC powered motor, or even a mechanical, wind up spring, motor. Forward of rear housing portion 204 is a stationary disk 220 with an inner circular ring gear 222. Around the periphery of disk 220, at approximately ninety degree intervals, are four idle gear assembly receiving bosses 224.

An outer disk 230 has an outer gear 232. Disk 230 is retained for rotation relative to disk 220 by four, outside, freely rotating, idle gear assemblies 234, which engage gear 232. Each gear assembly 234 is received for free rotation relative to disk 220 in a respective one of bosses 224. A fifth gear 236, which is driven by motor 210, also engages gear 232 and drives it around a generally central, horizontal axis. On the back face of outer disk 230 is a flange 238, which forms an irregular cam track. Extending through outer disk 230, within the periphery defined by cam track 238, is a cut-out cam 240. On the front of disk 230 are two spaced apart, forwardly projecting bosses 242, which are approximately at the 5 o'clock and 12 o'clock positions as shown in FIG. 8.

Soother 200 includes two characters 250, which conveniently in keeping with the aesthetic theme of soother 200 are in the form of baby birds. Characters 250 can of course, be made of any convenient selected type. While flying creatures such as birds and butterflies are particularly adapted to the general theme of the presently disclosed embodiment, toys having different themes could of course have characters of a different type more appropriate to their themes. Each of characters 250 have a body 252, a head 254, a tail 258 and a pair of appendages in the form of wings 260.

Both wings 260, and head 252 are carried for movement relative to body 252 in the same manner, and with substantially the same internal mechanism illustrated in FIGS. 4, 5 and 6, and in the previous embodiment, for carrying wings 110 and head 102 for movement with respect to body 102 of characters 100.

Extending rearwardly from each body 252 is a shaft 264. The end of shaft 264 inside body 252 is journalled for rotation substantially as shown and described with respect to the previous embodiment. As is best illustrated in FIG. 8, each shaft 264 is received for rotation relative to disk 230 in a respective boss 242. The end of shaft 264 opposite body 252 is secured to a pinion gear 266 on the back side of disk 230. Gear 266 engages inner ring gear 222 on stationary disk 220. Thus, as disk 230 is driven by motor 210 for rotation relative to disk 220 and housing 202, causing characters 250 to rotate around with respect to disk 220 and housing 202, each of appendages or wings 260 will be driven to move relative to the body of each of characters 250 in a generally front to back "flapping" action, and head 254 will pivot back and forth relative to body 252 in a "bobbing" action.

Forward of disk 230 is a stationary front disk 268, which is mounted to rear housing portion 204. In addition to baby bird characters 250 carried by disk 230, a third baby bird character 270 is carried by front disk 680. As with baby bird characters 250, character 270 has a body 252, a head 254, a tail 258 and a pair of appendages in the form of wings 260. Both wings 260, and head 252 are carried for movement relative to body 252 in the same manner, and with substantially the same internal mechanism illustrated in FIGS. 4, 5 and 6, and in the previous embodiment, for carrying wings 110 and head 102 for movement with respect to body 102 of characters 100. In addition character 270 is carried for generally up and down movement relative to front disk 268 and housing 202.

Extending rearwardly from character 270 is a shaft 264. While the end of shaft 264 inside the body of character 270 may be journalled for rotation substantially as shown and described with respect to the previous embodiment, it may also be secured against rotation since character 270 does not rotate. Rather than being secured to a pinion gear 266, the other end of shaft 264, after passing through a generally vertical slot 272 in disk 268, and an opening 274 in a cam follower 276, is secured to a connector 278 for rotation with the connector, which has a hexagonal socket (not shown) in back. Cam follower 276 engages cut-out cam 240 in disk 230.

Connector 278 is part of a universal joint assembly 280, which includes a universal drive member 282 having forward and rearward ball heads, 284 and 286, respectively, with hexagonal facets. Forward ball head 284 is in driving engagement with connector 284, while rearward ball head 286 is in motor driven engagement with motor 210. Thus, motor 210, which rotates disk 230 through gear 236, will also rotate shaft 264 of baby bird character 270 through universal joint assembly 280, to "flap" wings 260 and "bob" head 254. At the same time, as a result of the rotation of disk 230, with its cut-out cam 240, character 270 will, because of the engagement of cam follower with cam 240, move up and down relative to disk 268. A spring (not shown) biases the return of character 270 to its lower, down position.

A mother bird character 290, with a body 292 and a head 294, is positioned adjacent baby bird character 270 on front disk 268. In this embodiment, the only appendage of the mother bird character that moves is head 294. While body 292 is stationary with respect to disk 268, head 294 is mounted for approximately 180 degree oscillation about a generally vertical shaft (not shown) relative to body 292 and disk 268. Head 294 is connected by the shaft to an arm 296, which shuttles, general horizontally back and forth, causing head 294 to oscillate. Arm 296 is shuttled back and forth as a result of the engagement of a bifurcated cam follower 298 with the rotation of cam track 238 on the back of disk 230.

Figure 9:
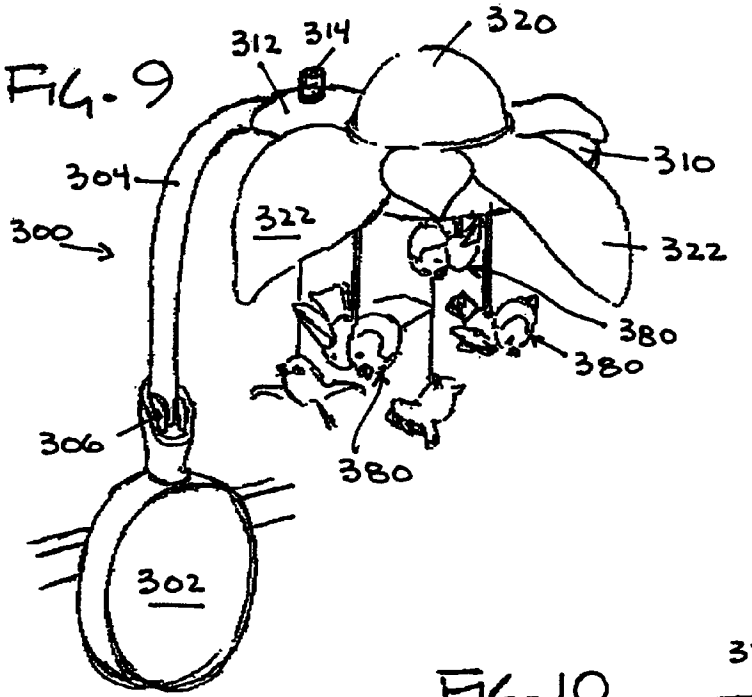
FIG. 9 is a perspective view of another embodiment of the present invention.

Another embodiment of the present invention is shown in FIGS. 9 through 13 in the form of a mobile 300. As illustrated in FIG. 9, mobile 300 may include a base 302, which can be secured to, clamped on, or slipped over a crib railing in any one of a number of conventional ways used for that purpose. Extending upwardly from base 302 is a support arm 304 that may conveniently be connected to base 302 for pivotal movement by a hinge connection 306. Support arm 304 includes an upper, generally horizontally disposed portion 308 extending over the inside of a crib. Attached adjacent the upper, generally horizontal portion 308 of support arm 304 is a housing 310. Extending upwardly from a rearward portion 312 of housing 310 is an on/off switch to 314. For the purposes of the present invention, an on/off switch such as 314 may be conveniently located on other portions of housing 310, or even on support arm 304 or base 302, although additional wiring would be required.

Carried in the rearwardly extending portion 312 of housing 310 is a motor, which may be similar to motor 30 of the previously described embodiment. Housing 310 may include, for aesthetic and thematic purposes, a central dome 320 and outwardly extending and downwardly depending cloud or leaf portions 322. Dome 320 may be transparent or translucent to let ambient light pass through, and/or may carry a light.

Figure 11:
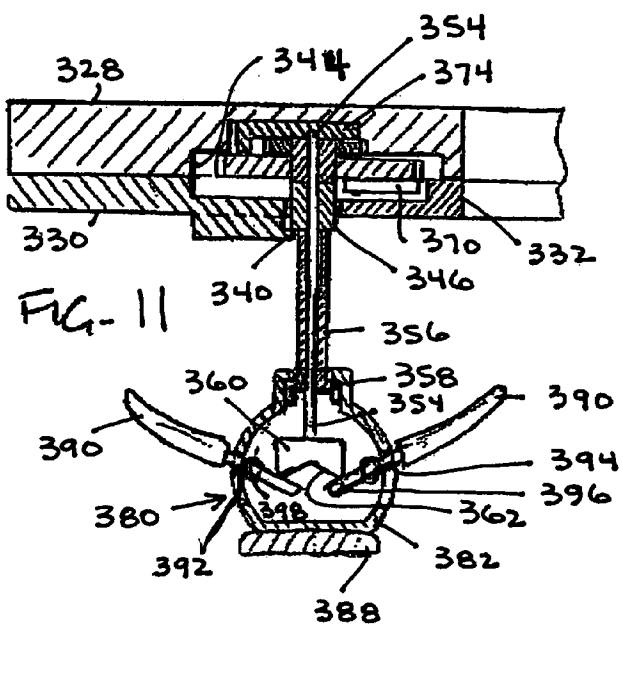
FIG. 11 is an enlarged, fragmentary sectional view taken generally vertically through the center, front to back, of one of the five characters of the embodiment shown in FIG. 9.
Figure 10:
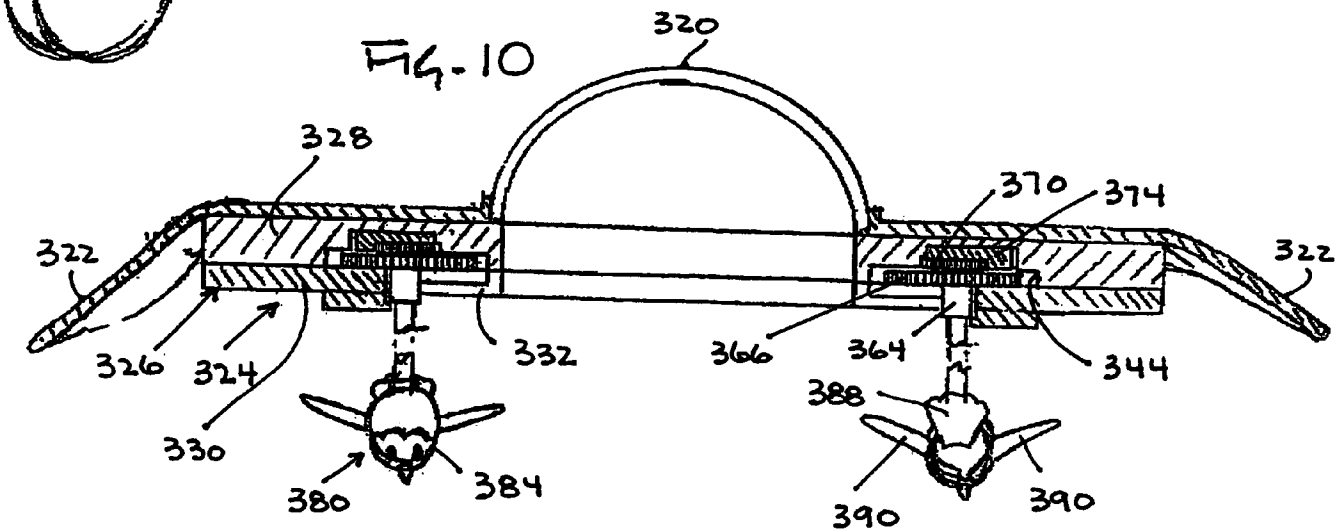
FIG. 10 is an enlarged, fragmentary sectional view taken generally vertically through the center, front to back, of the embodiment shown in FIG. 9.
Figure 13:
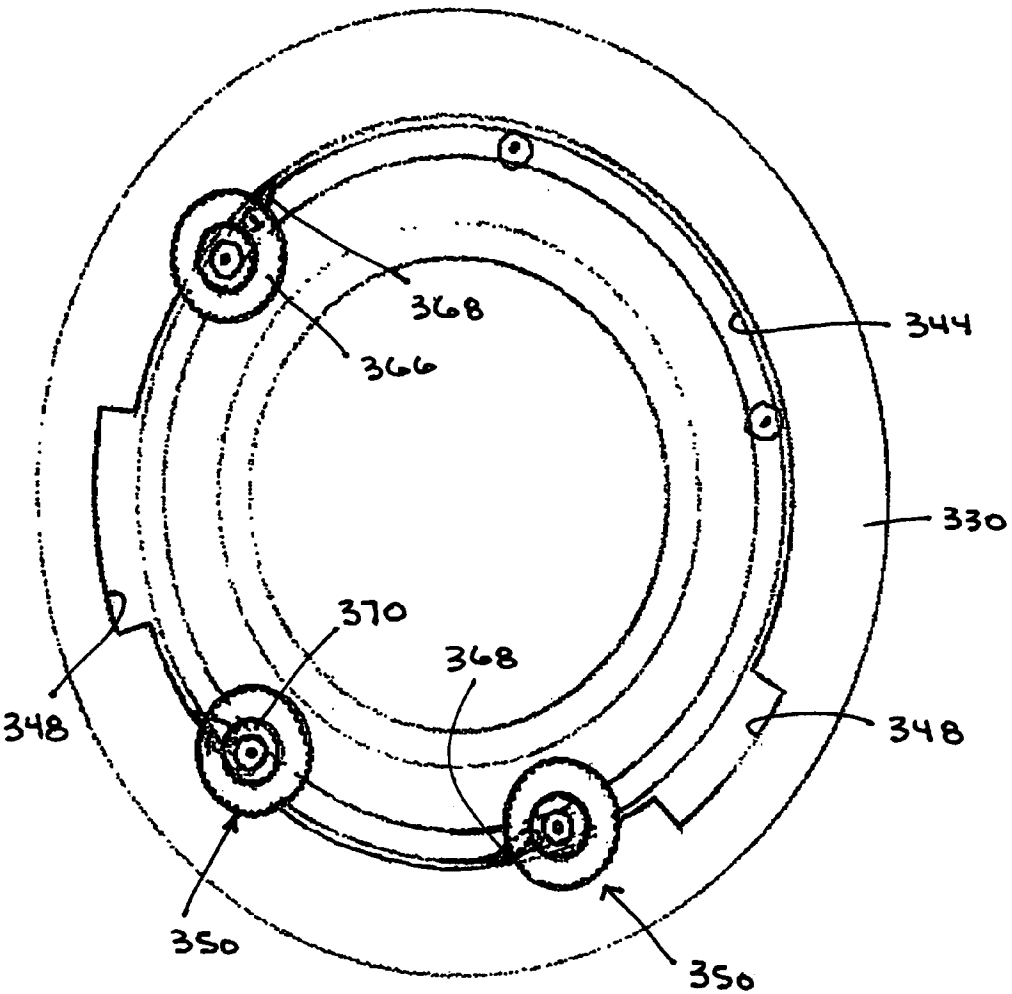
FIG. 13 is an enlarged, fragmentary sectional view taken generally horizontally through a portion of the mechanism of the embodiment shown in FIG. 9.
Figure 12:
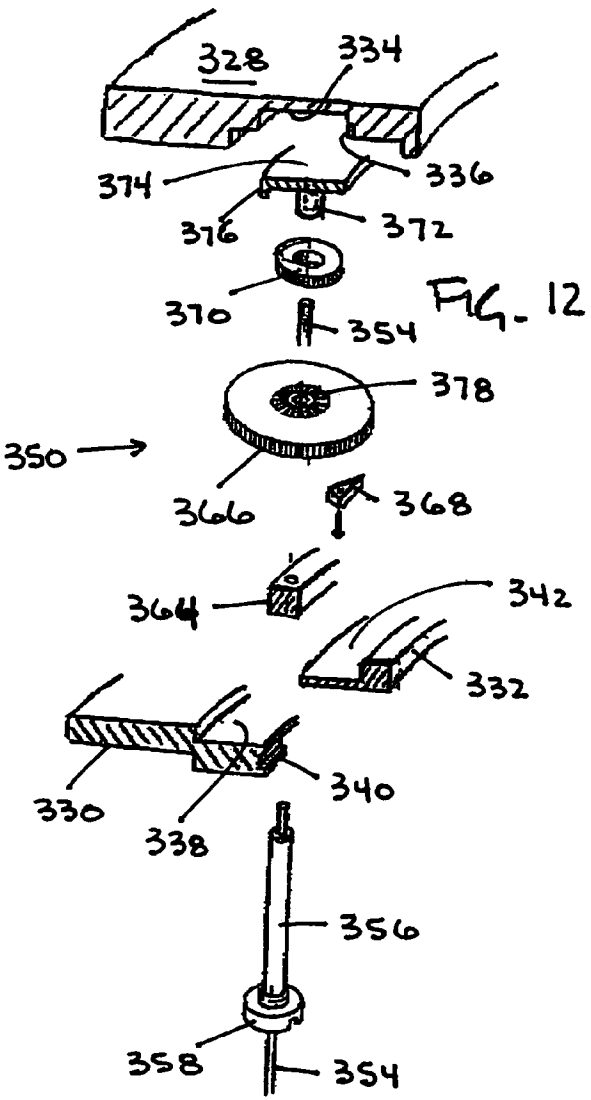
FIG. 12 is an enlarged, exploded perspective view of a portion of the mechanism of the embodiment shown in FIG. 9.

A drive assembly 324, which includes a generally horizontally disposed stationary ring assembly 326, is carried by housing 310. Stationary ring assembly 326 has a generally vertical central axis, and includes an upper ring 328 and generally parallel outer lower ring 330 and inner lower ring 332. As is best illustrated in FIGS. 10, 11 and 12, the underside of upper ring 328 is thus formed with a generally circular track or channel 334 in its underside. Along the inner periphery of channel 334 is an internal ring gear 336. Outer lower ring 330 is formed with a channel 338 in its upper side and a bottom, inwardly projecting lip 340. Inner lower ring 332 has a channel 342 in its upper side. Together rings 328, 330, and 332, and their respective channels 334, 338, and 342, define an interior, generally enclosed annular track or channel 344 having a circular opening 346 all the way around the bottom. Channel 344 also includes a number of interior, peripheral cut-out portions 348 in the outer wall of channel 344, as is best illustrated in FIG. 13. Bottom lip 340 of outer lower ring 332 covers an outer peripheral portion of circular opening 346 of channel 344.

Three character drive assemblies 350 are carried, substantially within and trapped against removal from interior channel 344, for rotation relative to stationary ring assembly 328 and housing 310. Each drive assembly 350 includes a generally vertical central shaft 354, which is carried for rotation in a generally vertical hollow shaft 356. At the bottom end of hollow shaft 356 is a retainer 358. Shaft 354 is journalled in, and extends below, retainer 358. A cam 360, with a sinusoidal cam face 362, is secured to shaft 354 for rotation with shaft 354.

Adjacent its upper end, hollow shaft 356 extends through a spacer ring 364, and is secured to a disk 366 and a pawl 368, which is attached to the underside of disk 366, for rotation with disk 366 and pawl 368. However, the upper portion of shaft 354 extends through hollow shaft 356, and hence through spacer ring 364, pawl 368 and disk 366. The upper portion of shaft 354 then extends through a gear 370, and into a mounting boss 372, in which shaft 354 is journalled for rotation. Boss 372 depends from, and may be integrally formed with, a ring gear 374 with gear teeth 376 on its outer periphery. Shaft 354 is secured to gear 370 for rotation with gear 370, which is seated atop disk 366, and frictionally engages it, assisted by face ratchet 378, so that gears 366 and 370 may rotate together, but also so that disk 366 may slip relative to gear 370 under certain conditions.

Each spacer ring 364 extends downwardly through circular opening 346, with the bottom of each spacer ring 364 abutting bottom lip 340. While each drive assembly 350 is trapped against removal, it is permitted to rotate freely around interior channel 344 as gear teeth 376 on the outer periphery of ring gear 374 are engaged by a drive gear from the motor, like drive pinion 32 of the previous embodiment. Alternatively the drive connection between the motor and ring 344 may be by frictional engagement. Thus ring 344 is driven by the motor so that each character drive assembly, and its attendant character rotate generally about the central vertical axis of housing 310. At the same time, each gear 370 is rotated by engagement with internal ring gear 336, and in turn rotates shaft 354.

Hollow shaft 356 and retainer 358 extend into, and are secured to, a character 380. As in the previous embodiment, each character 380, as illustrated in FIGS. 9, 10 and 11, are in the form of baby birds, but may be made of any convenient selected type. Again with the general theme of the presently disclosed embodiment, flying creatures such as birds and butterflies are particularly adapted to the theme. Toys having different themes could of course have characters of a different type more appropriate to their themes. Each of characters 380 have a body 382, a head 384, a tail 388 and a pair of appendages in the form of wings 390.

As is best illustrated in FIGS. 10 and 11, wings 390 are carried for movement relative to body 382. More particularly, a respective pivot arm 392 connects each wing 390 to body 382. Each pivot arm 392 has an outer portion 394 secured to wing 390, and an inner, cam follower portion 396. Between portion 394 and cam follower 396 is a mounting boss 398 with a generally central aperture that fits over a pin for rotation about the axis of the pin in a similar manner to that described with respect to the embodiment shown in FIGS. 4-6. The rotation of arm 392 is also similarly restricted by a slot in body 382 through which pivot arm 392 extends, and the pin is similarly carried by tabs that may be integrally formed as part of body 382.

Accordingly, it will be appreciated, from the illustrations of FIGS. 10 and 11, that inner shaft 354, with its cam 360, rotates about the axis of shaft 354, engagement of cam followers 396 of the respective pivot arms 392 of each of wings 390 with sinusoidal cam face 362 will cause the wings to be driven up and down simulating flapping of the wings. Because gravity maintains cam followers 396 in constant engagement with cam face 362, it is not necessary in this embodiment to use a cam slot as in the previous embodiment.

It will also be appreciated, particularly from FIGS. 10 and 11, that as the motor, drives ring 374 causing each of baby bird characters 380 to rotate relative to housing 312, generally about the central vertical axis of housing 312, because of the simultaneous engagement of gears 370 with internal ring gear 336 in the upper ring 328 causing rotation of shaft 354, appendages or wings 390 will be driven to move relative to the body of each of the characters in a generally up and down, front to back "flapping" action. Head 384 of each character 380 is also carried, in a manner similar to that shown and described in the previous embodiment, by body 382 for movement relative to body 382 in a generally up and down "bobbing" action as a result of the rotation of shaft 354.

While each character 380 rotates around channel 344 relative to the central axis of housing 312, bodies 382 may or may not also rotate about the axis of the concentric shafts 354 and 356. Bodies 382 are prevented from rotating about the axis of the concentric shafts 354 and 356 whenever pawl 368 engages a side wall of interior channel 344. Because pawl 368 is attached to disk 366, engagement of pawl 368 with a side wall of interior channel 344 prevents rotation of pawl 368, disk 366, hollow shaft 356, retainer 358, and body 382. However, when a drive assembly 350, or more particularly a pawl 370 reaches and enters one of notches or cut-outs 348, pawl 368, disk 366, hollow shaft 356, retainer 358, and body 382 are permitted to rotate, allowing the entire character 380 to spin around its own axis in addition to rotating around the central axis of housing 312.

Figure 14:
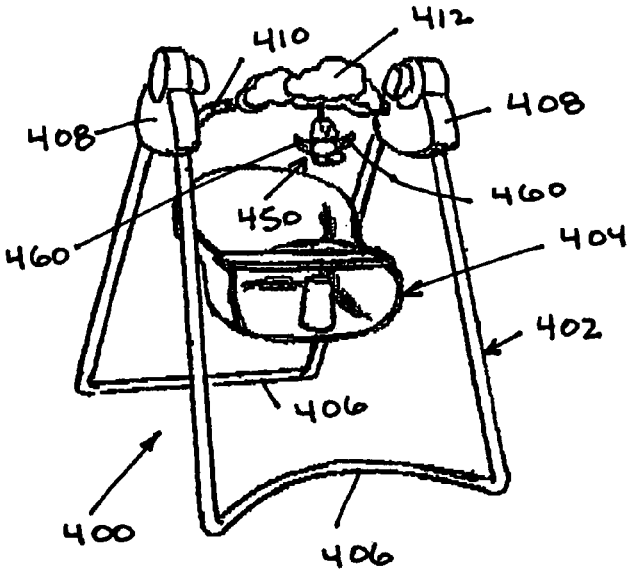
FIG. 14 is a perspective view of yet another embodiment of the present invention.
Figure 15:
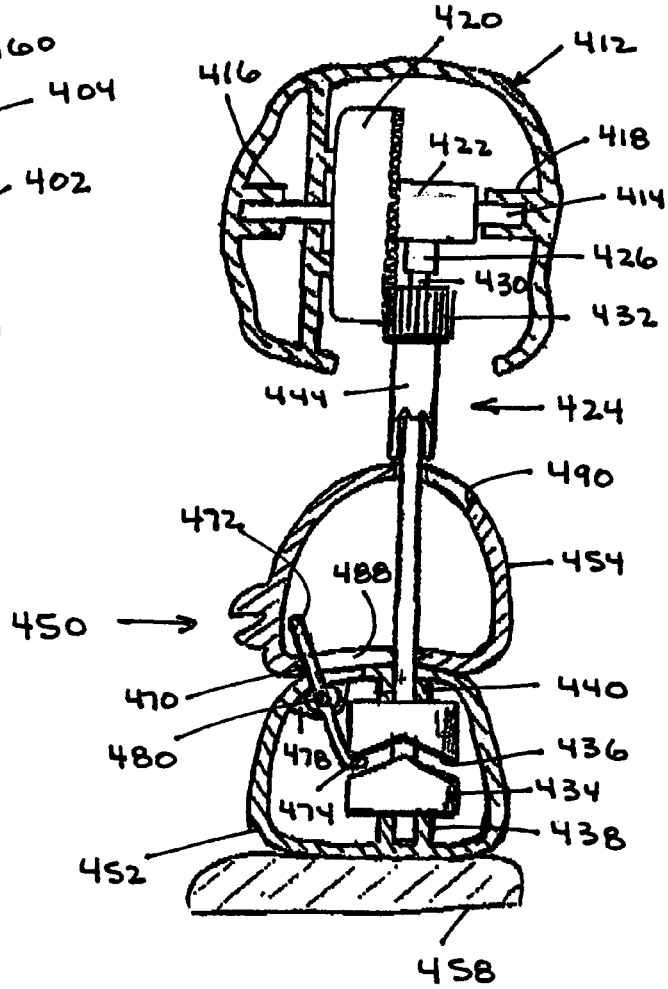
FIG. 15 is an enlarged, fragmentary sectional view taken generally vertically through the center, from front to back, of the mechanism and character of the embodiment shown in FIG. 14, but with the character rotated ninety degrees about a generally vertical axis from that illustrated in FIG. 14.

Yet another embodiment of the present invention is shown in FIGS. 14 and 15 in the form of an infant swing 400. As illustrated in FIGS. 14 and 15, swing 400 includes a frame 402 supporting a seat 404, which may be driven by a motor in a conventional manner to swing back and forth in a pendulum motion relative to frame 402 about a generally horizontal axis. More particularly, frame 402 includes a pair of spaced apart, generally U-shaped leg members 406. Adjacent free ends of each of leg members 406 are received in a respective housing connector 408. The motor and drive assembly for the swing may is carried in one of housing connectors 408.

Extending between spaced apart leg members 406, offset from, but generally parallel to the axis about which seat 404 is driven back and forth, is a generally horizontal bar 410. Mounted along at least a portion of bar 410 is a cloud shaped housing 412, which carries another part of drive assembly 424. Seat 404 is disposed beneath horizontal bar 410 and housing 412. Journalled in housing 412 is a shaft 414, which extends generally parallel to bar 410. Shaft 414, or more particularly each of its ends, is secured in a respective one of bosses 416 and 418, which may be molded as part of housing 412. Secured to shaft 414 is a crown gear 420.

Also carried by housing 412 and shaft 414 is a mounting sleeve 422, which rotates freely around shaft 414. Depending from sleeve 422 is a generally vertically disposed stem 426, which carries a depending, rotatable shaft 430. Secured adjacent the upper end of shaft 430, for rotation with shaft 430, is a gear 432. Alternatively, crown gear 420 may be mounted to rotate relative to shaft 414, and be driven by another motor. Such alternative rotation of crown gear 420 would initially drive gear 432, causing shaft 430 to rotate, and causing shaft 430, stem 426 and sleeve 422 to pivot about shaft 414 until gravity overcomes the frictional engagement of crown gear 420 and gear 432, resulting in gear 432 slipping, and shaft 430, stem 426 and sleeve 422 dropping back down.

Adjacent, the opposite, bottom end of shaft 430, a cylinder 434 having a sinusoidal cam slot 436 is secured to shaft 430, for rotation with the shaft. The other end of shaft 430 is journalled for rotation in boss 438, which is formed as an integral part of a character 450, more particularly, part of body 452 of character 450. A flange 440 projects down from the upper part of body 452 into body 452. The upper end of cylinder 434 bears against flange 440. A spacer 444 extends between gear 432 and the top of head 454. Character 450 may be positioned in different orientations by manually rotating the character about the axis of shaft 430.

As in the previous embodiments, character 450 is conveniently in the form of a bird, although it could be made of any convenient selected type of character appropriate to the theme of the swing. In addition to body 452 and head 454, character 450 has a tail 458 and a pair of appendages in the form of wings 460. While not illustrated in FIGS. 14 and 15 of this embodiment, wings 460 are carried for movement relative to body 452 in the same way as is illustrated in FIGS. 4, 5 and 6, with respect to wings 110. In addition head 454 is carried for movement relative to body 452, as is illustrated in FIG. 15, in a generally back and forth "bobbing" action. Head 454 is connected to body 452 by a pivot arm 470, which is similar to the pivot arms (not shown in FIGS. 14 and 15) for wings 460.

Pivot arm 470 has an outer portion 472 extending into head 454 and an inner cam follower 474 within body 452. A mounting boss 478 between outer portion 472 and cam follower 474 is mounted for rotation about a pin 480 carried by spaced apart tabs 486 (one of which is shown in FIG. 15) extending inwardly into body 452. Cam follower 474 rides in sinusoidal cam slot 436 causing arm 470 to pivot back and forth about pin 480. The back and forth pivoting movement is transmitted to head 454 causing it to pivot back and forth relative to body 452 by outer portion 472 of arm 470. A slot 488 in the bottom of head 454 permits the movement the head in a back and forth pivoting movement about shaft 430, which passes through head 454. There is also a slot 490 in the top of head 454 which permits the head to move back and forth relative to shaft 430.

Character 450, more particularly body 452, is itself carried by housing 412, or more particularly shaft 414 of the drive assembly, for movement in a pendulum fashion about a generally horizontal axis relative to the housing as the motor engages the drive assembly causing seat 404 to pivot back and forth like a pendulum, and in turn drive character 450. Thus, bird character 450 will swing back and forth about the generally horizontal axis, and at the same time, wings 460 and head 454 will be driven in a "fluttering" and "bobbing" action, respectively, as gear 432 engages crown gear 420 rotating shaft 430, and cylinder 434 with sinusoidal cam slot 436, causing wings 460 to "flutter" and head 452 to "bob".

Figure 16:
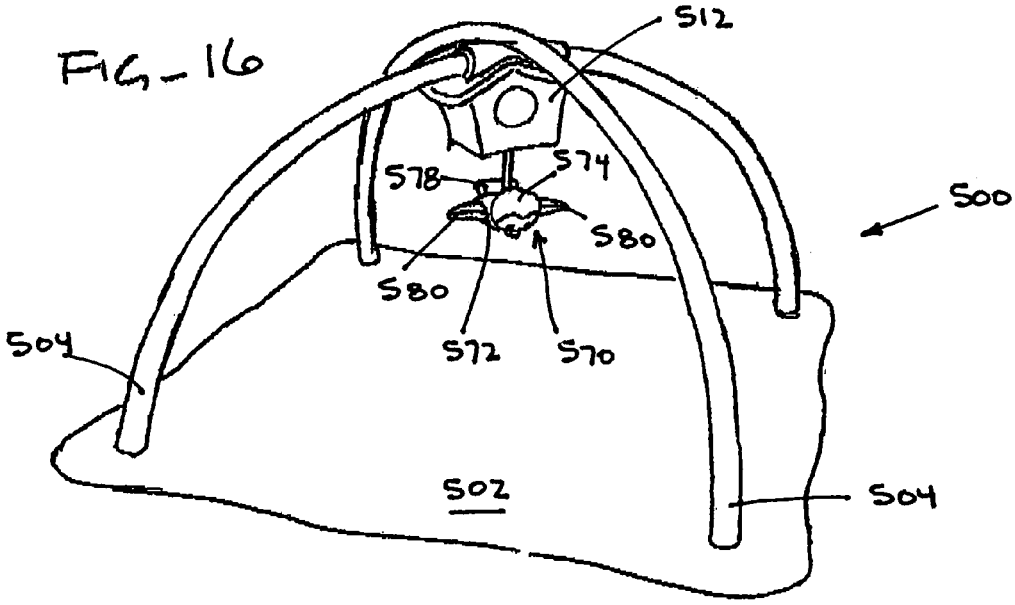
FIG. 16 is a perspective view of still another embodiment of the present invention.

Still another embodiment of the present invention is shown in FIGS. 16 through 19 in the form of an infant exercise toy, play mat, or gym 500. As illustrated in FIG. 16, gym 500 may include a base 502 and one or more arches 504. Free ends 506 of each arch 504 are attached to, or mounted in, base 502. Adjacent the top of an arch, or as illustrated in FIG. 16, adjacent the intersection of two arches 504, is a housing 512. In keeping with themes of previous embodiments, housing 512 may be in the form of a birdhouse. Carried in housing 512 is a motor 520. Most conveniently, motor 520 is a battery powered motor. However, motor 520 may just as readily for purposes of the present invention be a plug-in, AC powered motor, or even a mechanical, wind up spring, motor.

Figure 17:
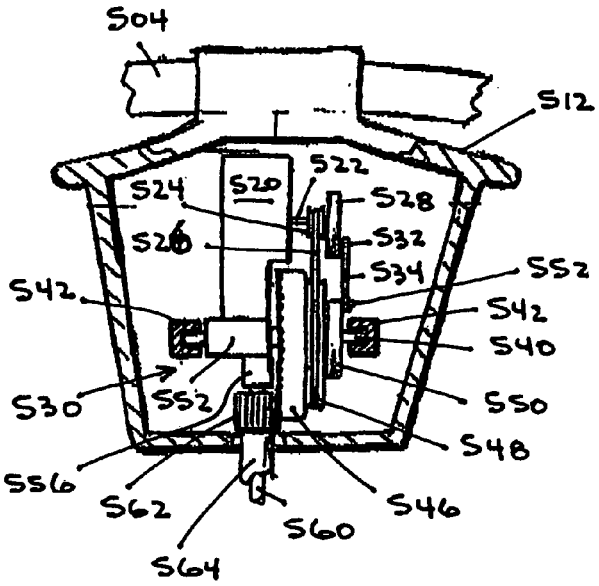
FIG. 17 is an enlarged, fragmentary sectional view taken generally vertically through the center of the mechanism of the embodiment shown in FIG. 16.

Extending from motor 520 is a drive shaft 522 to which, as illustrated in FIG. 17, a pulley 524, carrying a drive belt 526, and a drive disk 528 are secured for motor driven rotation, forming part of a drive assembly 530. Extending outwardly from drive disk 528 is a pin 532. A link 534 is attached to pin 532 such that link 534 may rotate with respect to pin 532.

Drive assembly 530 includes a generally horizontally disposed shaft 540. A pair of spaced apart trunnions 542, which may be formed a part of the inside of housing 512, journal shaft 540 between the trunnions for rotation about the axis of shaft 540. Secured on shaft 540, for rotation with the shaft, are a crown gear 546, a pulley 548, and a disk 550 with a pin 552 extending outwardly from a face of the disk, radially offset from the axis of the disk. Belt 526 connects drive pulley 524 and pulley 548 to rotate shaft 540. Link 534 connects drive disk 528 and disk 550.

Also carried by housing 512 and shaft 540 is a mounting sleeve 552, which rotates freely around shaft 540. Alternatively, both shaft 540 and sleeve 552 may be mounted so as not to rotate, and crown gear 546 and pulley 548 may rotate together, relative to shaft 540. Depending from sleeve 552 is a generally vertically disposed stem 556, which carries a depending, rotatable shaft 560. Secured adjacent the upper end of shaft 560, for rotation with shaft 560, is a gear 562. A spacer 564 extends below gear 562.

In keeping with the theme of play gym, as illustrated in FIG. 16, a character 570 in the form of a bird is provided. Character 570 can of course, be made of any convenient selected type. While a flying bird is particularly adapted to the general theme of the presently disclosed embodiment, toys having different themes could of course have characters of a different type more appropriate to their themes. Bird 570 has a body 572, a head 574, a tail 578 and a pair of appendages in the form of wings 580.

Although not illustrated in this embodiment, the opposite, bottom end of shaft 560 may be mounted in body 572, in a manner similar to that previously described with respect to the swing embodiment. Also, although not again illustrated for this embodiment, shaft 560 has a cam attached adjacent its bottom end, within body 572, to cause wings 580 to "flutter" and head 574 to "bob" with respect to body 572 in the same manner, and with the same mechanisms, as were described in detail with respect to the birds bird characters 380 of the mobile embodiment, particularly as illustrated in FIG. 11. Thus, shaft 560 causes the head and wings to move relative to the body of bird simultaneously with the rocking motion of bird 570 relative to a generally horizontal axis through housing 512 caused by the driving of disk 550 by link 534.

Figure 18:
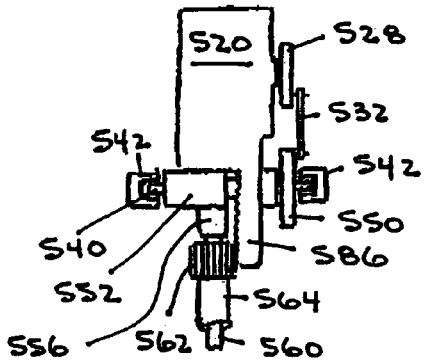
FIG. 18 is an enlarged, fragmentary sectional view taken generally vertically through the center of an alternate mechanism for the embodiment shown in FIG. 16.

An alternative mechanism is shown for this play gym embodiment of FIG. 16 in FIG. 18. In this alternative mechanism, a stationary arcuate gear rack 586 replaces the rotating crown gear and pulley, as well as the need for the drive pulley and belt of the mechanism illustrated in FIG. 17. Thus, as the drive disk 528 and link 532 rotates disk 550, causing shaft 542 to rock back and forth about its axis in trunnions 542, gear 562 will engage rack 586, causing shaft 560 to rotate first in one direction about a generally vertical axis, and the in the opposition direction, which will still result in the movement of wings 580 and head 574 substantially as previously described.

Figure 19:
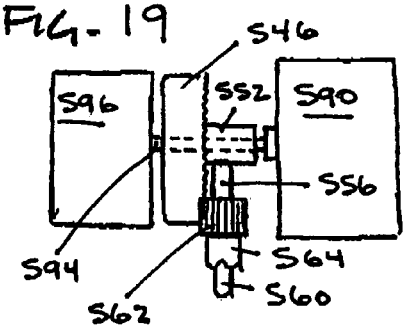
FIG. 19 is an enlarged, fragmentary sectional view taken generally horizontally through an another alternate mechanism for the embodiment shown in FIG. 16.

Another alternative mechanism is shown for this play gym embodiment of FIG. 16 in FIG. 19. In this alternative mechanism, a motor 590 includes an extended drive shaft 594, which is journalled at its opposite end for rotation in a block 596. Shaft 594 carries crown gear 546 and sleeve 552 for rotation with shaft 594. Depending from sleeve 552 is a generally vertically disposed stem 556, which carries a depending, rotatable shaft 560. Secured adjacent the upper end of shaft 560, for rotation with shaft 560, is a gear 432. A spacer 564 extends between gear 562 and the top of head 574. The opposite, bottom end (not shown) of shaft 560 may be attached to body 572, in a manner similar to that previously described with respect to the swing embodiment, for rotation of the body relative to housing 512. Wings 580 and head 574 are driven for movement relative to body 572, as previously described with respect to the other alternate mechanisms for this embodiment, at the same time as bird 570 moves relative to the housing.

Figure 20:
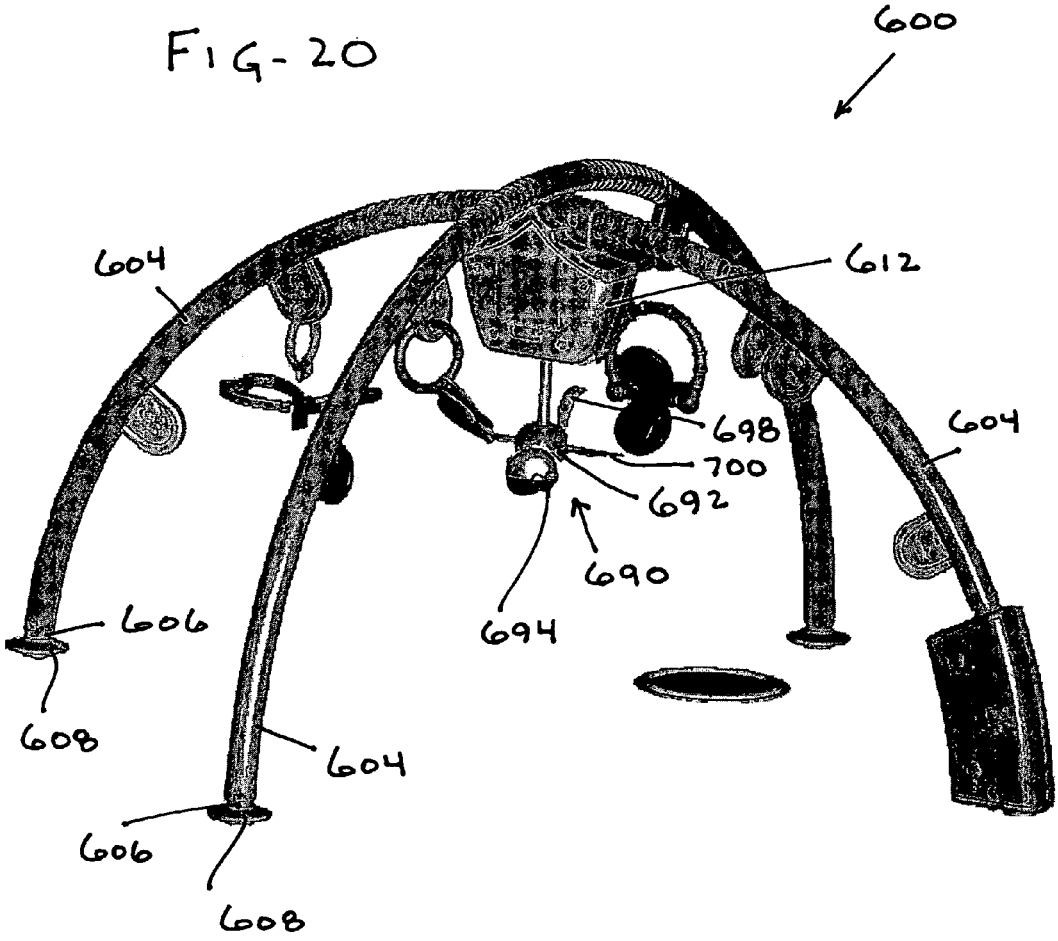
FIG. 20 is a perspective view of an another additional embodiment of the present invention.
Figure 21:
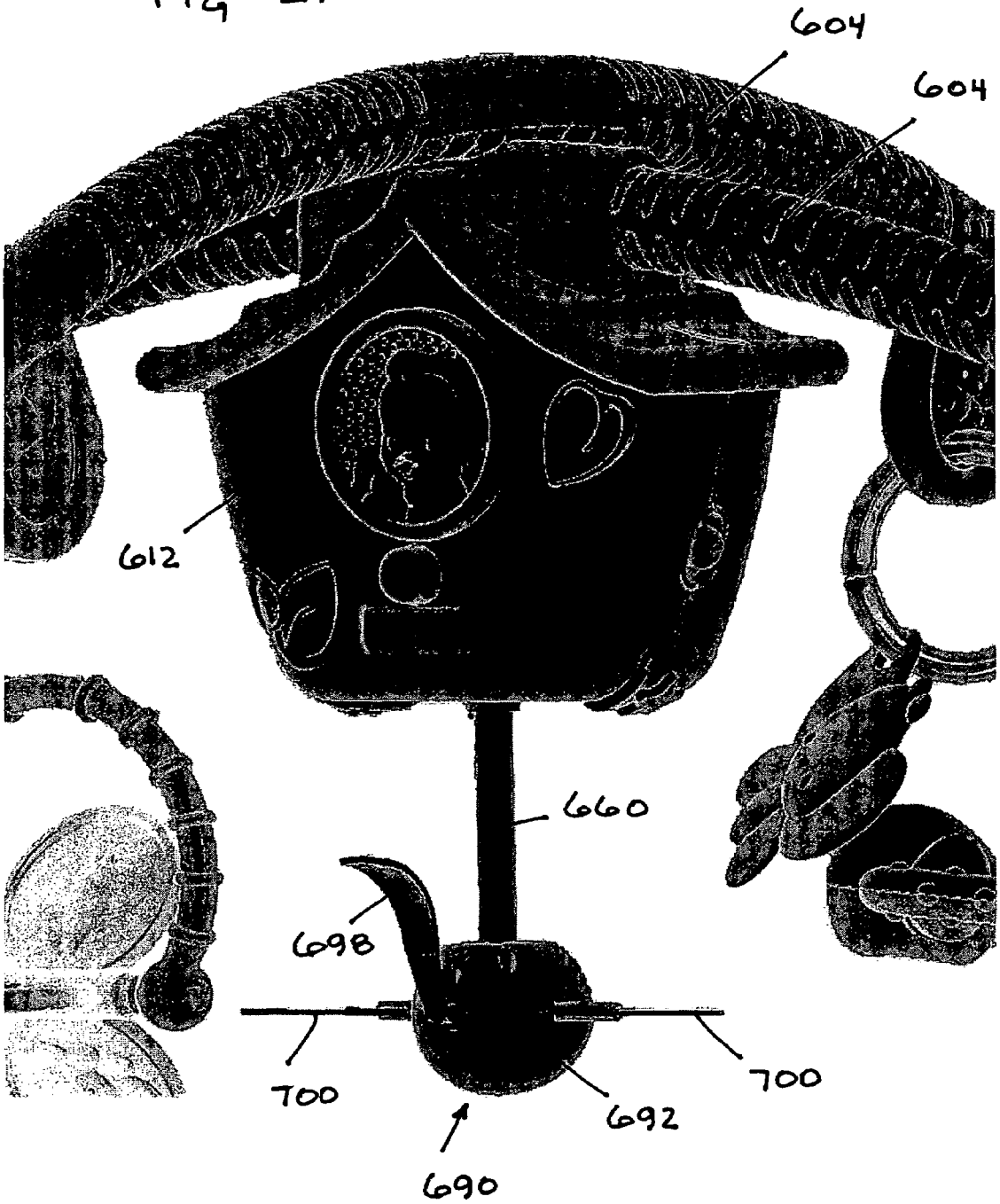
FIG. 21 is an enlarged, fragmentary perspective view of a portion of the embodiment shown in FIG. 20 from the other side.
Figure 22:
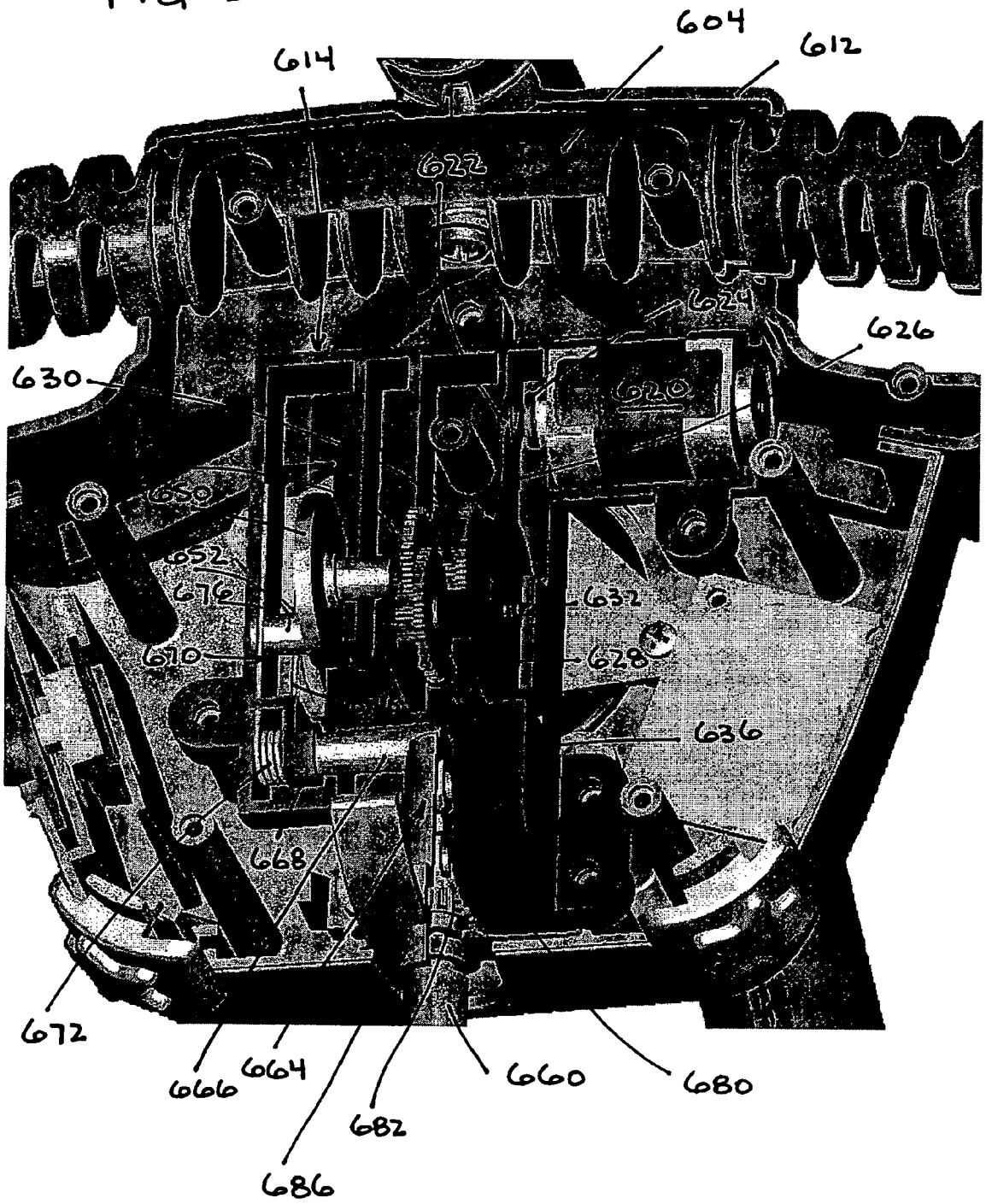
FIG. 22 is an enlarged, fragmentary sectional view taken generally vertically through the center of the mechanism of the embodiment shown in FIG. 20.

Yet another embodiment of the present invention in the form of an infant exercise toy, play mat, or gym 600 is shown in FIGS. 20, 21 and 22. As illustrated in FIG. 20, gym 600 may include a base and one or more arches 604. Free ends 606 of each arch 604 are attached to, or mounted in, the base. Alternatively, intersecting arches 604 may be conveniently be provided with bases 608 for free standing on any generally planar surface, such as a floor. Adjacent the top of an arch, or as illustrated in FIGS. 20 and 21, adjacent the intersection of two arches 604, is a housing 612. As with the previous embodiment, housing 612 may be in the form of a birdhouse in keeping with the themes of the other embodiments.

Inside housing 612 is a stationary mounting member 614 carrying motor 620, which is most conveniently is a battery powered motor. However, as in the other embodiments, motor 620 may just as readily for purposes of the present invention be a plug-in, AC powered motor, or even a mechanical, wind up spring, motor. Extending from motor 620 is a drive shaft 622 to which, as illustrated in FIG. 22, a drive pulley 624, carrying a drive belt 626, is secured for motor driven rotation. Belt 626 drives a pulley 628, forming part of a drive assembly 630, on a journalled shaft 632, which also carries a number of gears of a gear train 636. Another journalled shaft 640 carries other gears of gear train 636. On the end of shaft 640, generally opposite motor 620, is an eccentric drive 650 having a drive lobe 652.

Disposed below pulley 628 and gear train 636 is a generally vertical shaft 660. Adjacent its upper end shaft 660 is connected to, an L-shaped member 664 having a generally horizontal rod 666. Mounting member 614 includes a sleeve 668 in which rod 666 is received for rotation. Thus, as rod 666 rotates back and forth about a generally horizontal axis, shaft 660 will swing back and forth in a generally vertical plane. Secured to rod 666, for rotation with rod 666, is a generally U-shaped drive spring 670, the bight portion 672 of which has a number of tightly wound coils that frictionally engage and drive rod 666. Extending upwardly, as shown in FIG. 22, from bight portion 672 are a pair of spaced apart, generally vertical, legs 676. Drive lobe 652 alternately engages first one, and then the other, of legs 676 to cause rod to rotate or oscillate back and forth, and in turn swing shaft 660 back and forth about a generally horizontal axis.

Mounting member 614 includes a stationary arcuate segment 680 of a crown gear. Secured to shaft 660, for rotation with shaft 660, is a pinion gear 682. As shaft 660, which is carried for rotation in L-shaped member 664, swings back and forth, pinion gear 682 engages gear segment 680 causing shaft 660 to rotate. A spacer 686 extends below gear 682.

In keeping with the theme of play gym, as illustrated in FIGS. 20 and 21, a bird character 690 depends from shaft 660. Bird 690 has a body 692, a head 694, a tail 698 and a pair of appendages in the form of wings 700. Although not illustrated in this embodiment, shaft 660 has a cam attached adjacent its bottom end, within body 692, to cause wings 700 to "flutter" and head 694 and/or tail 698 to "bob" with respect to body 692 in the same manner, and with the same mechanisms, as were described in detail with respect to the birds bird characters 380 of the mobile embodiment, particularly as illustrated in FIG. 11. Thus shaft 660 causes the head and wings to move relative to the body of bird simultaneously with the rocking or swinging motion of bird 690 relative to housing 612 caused by the driving of pulley 628 by belt 626.

As a variation, motor 620 of this embodiment, and motors 520 and 590 of the previous embodiment could be eliminated, along with that part of the drive assembly transferring power to the rest of the drive assembly. In such a variation, power would be provided by the child, or an adult, manually pushing the character to drive it pivot back and forth in a pendulum motion, which would then cause simultaneous driving of the appendages, such as the wings and/or head in the manner previously described.

While particular embodiments of the invention have been shown and described, with some further suggested alternatives, further variations and modifications will occur to those skilled in the art. It is intended in the appended claims to cover all such variations and modifications that come within the true spirit and scope of the present invention.

What is claimed as new and desired to be secured by Letter Patent is:

1. A toy comprising:

a housing;

at least two characters;

each of the at least two characters having at least one appendage;

each of the at least two characters being carried by the housing and mounted for movement with respect to the housing;

a drive assembly, carried by the housing, simultaneously driving the body of each of the at least two characters to move relative to the housing and driving the at least one appendage of each of the at least two characters to move relative to the respective body of each of the at least two characters; and a single motor powering the drive assembly.

2. The toy of claim 1 in which the body of each of the at least two characters is driven to move relative to the housing in the same manner.

3. The toy of claim 1 in which the at least one appendage of each of the at least two characters is driven to move relative to the respective body in the same manner.

4. The toy of claim 1 in which the body of each of the at least two characters is driven to move relative to the housing in a different manner.

5. The toy of claim 1 in which the at least one appendage of each of the at least two characters is driven to move relative to the respective body in a different manner from the at least one appendage of the other of the at least two characters is driven to move relative to its respective body.

6. A toy comprising:

a housing;

at least one character;

the at least one character being carried by the housing for movement relative to the housing;

the at least one character having a body and at least one appendage that is carried by the body for movement relative to the body;

a drive assembly camed by the housing to simultaneously drive the body of the at least one character to move relative to the housing and drive the at least one appendage to move relative to the body;

the drive assembly including at least one disk, having a center, that rotates relative to the housing; and at least one shaft that is carried by the at least one disk, radially offset from the center of the disk, for driven rotation relative to the disk.

7. The toy of claim 6 in which the at least one shaft drives the at least one appendage to move relative to the body.

8. The toy of claim 7 in which the drive assembly includes:

at least one pair of concentric shafts; and one of the at least one pair of concentric shafts being driven independent of the other of the at least one pair of concentric shafts.

9. A toy comprising:

a housing having a generally centrally disposed axis;

at least one character;

the at least one character being carried by the housing for movement relative to the housing;

the at least one character being carried by the housing for movement relative to the housing rotates around the generally centrally disposed axis;

the at least one character having a body and at least one pair of appendages that are carried by the body for movement relative to the body;

the at least one pair of appendages each having a portion extending into the body;

a drive assembly carried by the housing to simultaneously drive the body of the at least one character to move relative to the housing and drive the at least one appendage to move relative to the body; and the drive assembly includes a cam that enaaaes the extending portion of each of the at least one pair of appendages.

10. The toy of claim 9 in which the body of the at least one character is also driven for rotation around a second axis that is generally parallel to, but spaced from, the generally centrally disposed axis.

11. The toy of claim 10 including: a generally circular channel having an outer wall;

the at least one character being driven for rotation around the channel;

the outer wall of thechannel having at least one notch;

a pawl carried around the channel as the at least one character is driven for rotation around the channel; and the pawl releasing the body for rotation around the second axis upon the pawl entering the at least one notch.

* * * * *